US005888448A

United States Patent [19]

Lonardi

[11] Patent Number: 5,888,448

[45] Date of Patent: Mar. 30, 1999

[54] TAP-HOLE DRILLING MACHINE

[75] Inventor: Emile Lonardi, Bascharage, Luxembourg

[73] Assignee: Paul Wurth S.A., Rue D'Alsace, Luxembourg

[21] Appl. No.: 800,424

[22] Filed: Feb. 14, 1997

[30] Foreign Application Priority Data

Feb. 21, 1996 [LU] Luxembourg ..... 88 718

[51] Int. Cl.[6] ..... C21C 5/48

[52] U.S. Cl. ..... 266/271; 266/45

[58] Field of Search ..... 266/45, 271, 272

[56] References Cited

U.S. PATENT DOCUMENTS 3,190,629 6/1965 Draper ..... 266/271
4,431,171 2/1984 Foster ..... 266/271
5,069,430 12/1991 Woodings et al. ..... 266/271

FOREIGN PATENT DOCUMENTS

0519397 B1 12/1992 European Pat. Off. .

*Primary Examiner*—Scott Kastler
*Attorney, Agent, or Firm*—Beveridge, DeGrandi, Weilacher & Young, LLP

[57] ABSTRACT

The invention relates to a tap-hole drilling machine comprising a separate guiding means for a tap-hole drill and a driving means to move this guiding means between a working position and a rest position. In the working position, the guiding means forms a guide for a tap-hole drill. In the rest position, the guiding means is in a protected position behind a protective shield. The guiding means and driving means are combined in compact cassette-form guiding and protection unit which is removably suspended at the front end of the mount. The protective shield is suspended on the front face of this cassette-form guiding and protection unit and has a through hole for a tap-hole drill.

20 Claims, 5 Drawing Sheets

57
70
68'
68''
71'
71''
62'
66
62''
26
60
60
64
42
44'
46'
48
50
40'
56'
56''
65
58'
58''
16
32
34

100
68'
68"
102
71'
62'
66
62"
71"
26
52
54
52
54
56'
56"
40'
80
65
58'
58"
69'
69"
16
32

TAP-HOLE DRILLING MACHINE

FIELD OF THE INVENTION

The invention relates to a drilling machine for drilling tap-holes in shaft furnaces, more particularly blast furnaces.

BACKGROUND OF THE INVENTION

Such drilling machines have been known for a long time. They include a mount arranged in axial extension of the tap-hole. A drill drive is slidably arranged on the mount. This drill drive causes a tap-hole drill to rotate, generates forward feed and withdraws the tap hole drill from the tap-hole. For large blast-furnaces such tap-hole drills can be as much as four meters long. They consist essentially of a smooth drill-rod carrying a drill head at its front end. The rear end of the drill rod is clamped in a chuck of the drill-drive.

At its front end, the mount has a protective shield of refractory material. The main function of the protective shield is to protect the mount and the drill drive against the molten metal streaming out of the drilled tap-hole. Another function of the protective shield is to guide the tap-hole drill during the drilling operation.

When the tap-hole is opened, the protective shield regularly comes into contact with the molten metal. The protective shield is thereby heavily stressed, particularly in the region of its guide hole for the tap-hole drill, so that, in a comparatively short time, the protective shield can no longer guide the drill rod properly. In order to re-establish proper guidance of the drill rod, the protective shield has to be replaced, even though it is still capable of performing its protective function.

EP-A-0519397 discloses a tap-hole drilling machine which has a special guiding means for the tap-hole drill at the front end of its mount. This guiding means is formed by two guide sections made from steel or cast iron, each being pivotably attached to the mount by means of a lever arm. A hydraulic or pneumatic cylinder attached to the mount is connected to the two lever arms by means of a linkage system, so that it can pivot the two guide sections from a working position, in which they cooperate to form a drill guide for a tap-hole drill, sideways to a rest position. In this rest position, the two guide sections are located to the side of the mount, behind a protective shield attached to the front face of the mount. In the device described in EP-A-0519397, the front protective shield performs only the function of protecting the two guide sections in the rest position. Because of its wide aperture in the region of the drilling axis, the front protective shield is actually not capable of protecting the mount and the drill drive against the molten metal issuing from the drilled tap-hole. It should also be pointed out that, despite the protective shield, the guiding device at the end of the mount represents a very exposed unit, so that damage cannot be completely ruled out. It must therefore be ensured that even serious damage to the guiding device must not cause an excessively long down-time of the tap-hole drilling machine. This assurance does not exist, however, with the tap-hole drilling machine described above.

The present invention intends to eliminate or reduce the above-mentioned disadvantages of the prior art tap-hole drilling machines.

SUMMARY OF THE INVENTION

The tap-hole drilling machine of the invention includes a mount and a compact cassette-form guiding unit that is removably suspended on the front end of the mount. A protective shield is removably suspended on the cassette-form guiding unit. This protective shield has a through hole for passing therethrough a tap-hole drill. A guiding means for the tap-hole drill is arranged behind the protective shield. A driving means is capable of moving this guiding means between a working position and a rest position, wherein, in said working position, the guiding means forms a drilling guide for a tap-hole drill, and wherein, in said rest position, the guiding means is located in a protected position behind said protective shield. It will be noted that the protective shield still has a through hole for the tap-hole drill, but this through hole no longer has to perform a guidance function for the tap-hole drill. The guidance function for the tap-hole drill is instead undertaken by the guiding means. Since guidance of the tap-hole drill at the front end of the mount is by no means required until the end of the drilling operation (i.e. until the drill breaks through into the molten metal), the guiding means can consequently be moved from the exposed guiding position in an axial extension of the through hole to a protected position behind the protective screen before the drilling operation is completed, i.e. before the molten metal issues from the drilled tap-hole. The risk of the guiding means coming into contact with the molten metal is thereby greatly reduced, and its service life is consequently extended. Since the through hole in the protective screen no longer has to perform a guidance function, slight to average wear on the protective shield in the region of the through hole hardly impairs the function of the protective shield. In consequence, the protective shield has to be replaced less frequently. According to an important aspect of the invention, the guiding means and driving means are combined in a compact removable cassette-form unit removably suspended at the front end of the mount. In the event of major damage, the front guiding device can consequently be simply unhooded as a compact unit and, for example, be replaced by a reserve unit. If the guidance device at the front end of the mount is something of a nuisance during particular operations carried out at the tap-hole, it can similarly be quickly unhooked. According to a further important aspect of the invention, the protective shield is removably suspended at the cassette-form guidance unit. The protective shield can thus be easily dismantled, without having to dismantle the entire guidance unit. It is thereby possible, for example, to replace a protective shield quickly by another, or to remove the protective shield, if it is not absolutely essential but is something of a nuisance.

In a preferred embodiment the cassette-form guidance unit has a front place facing said tap-hole when said mount is arranged in front of said tap-hole. The protective shield is then suspended in front of said front plate. The latter may be smaller than the protective shield, but should nevertheless be designed so as to confer a residual protection for the guiding means in its rest position, when the protective shield is removed.

There are many different possibilities for designing the guiding means. It can, for example, be designed as a single-arm retractable gripper which can be pivoted sideways and upwards into a protected position behind the protective shield. In a simple but nevertheless very effective design, the guiding means has two pivoted arms, each having a guide section at its free end. In the first position of the guiding means, the two guide sections collaborate with each other in a complementary manner, in such a way that they form a guide hole or a guide channel for a tap-hole drill. The guide sections can, for example, be angle sections, forming a square guide-hole for a tap-hole drill.

The driving means advantageously has two levers, to which the arms are firmly screwed. It should be emphasized that the arms with the guide sections are a guiding means which is relatively cheap to manufacture, is also easy to change, and consequently represents an extremely economical wearing part.

The tap-hole drilling machine advantageously has a control means which operates the driving means as a function of the position of the displaceable drill drive, in such a way that the guiding means is moved from the working position to the rest position before the tap-hole has been completely drilled.

BRIEF DESCRIPTION OF THE DRAWINGS

Preferred embodiments of the invention are described below, by reference to the attached drawings, which show.

DETAILED DESCRIPTION OF THE INVENTION

Figure 1:
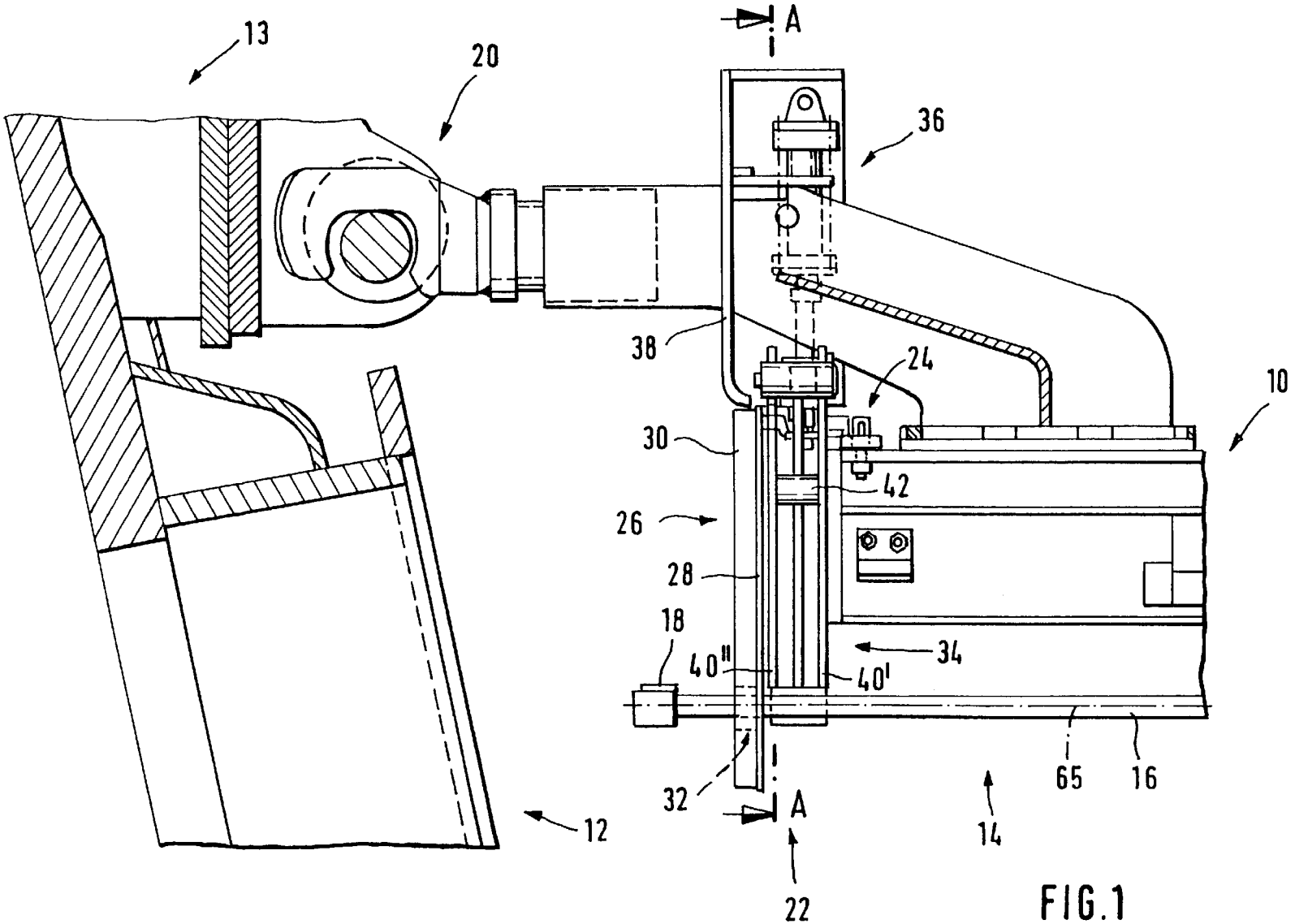
FIG. 1 a side view of the front end of a drill mount with a suspended guiding device, said drill mount being in the drilling position in front of a tap-hole.

FIG. 1 shows the front end of the drill mount 10, arranged in a drilling position in front of a tap-hole 12. This drill mount 10 is part of a known tap-hole drilling machine, as used to drill the tap-hole 12 of a blast furnace (represented in FIG. 1 by blast-furnace jacket 13). Reference number 14 indicates the head end of a tap-hole drill, consisting essentially of a cylindrical drilling rod 16 up to four meters long (diameter approx. 4 cm) and a drilling head 18. The rear end (not shown) of the drilling rod 16 is clamped in the chuck of a drill drive (not shown). The drill drive causes the tap-hole drill 14 to rotate, generates the forward feed required for drilling, and withdraws the tap-hole drill 14 from the tap-hole. For this purpose, the drill drive is displaceable along the mount 10. The mount is advantageously supported on the blast-furnace jacket 13 while in the drilling position, for example by means of a hook 20.

Reference number 22 indicates a guiding device for the tap-hole drill at the front end of the mount 10. The guiding device 22 is built as a compact cassette-form unit, which is suspended from the front end of the mount 10 by means of pins 24. It can consequently be easily fitted and removed as a compact unit.

The guiding device 22 has a front protective shield 26 facing the tap-hole. This protective shield 26 comprises a metal support-plate 28 with a coating or lining 30 of a refractory material. The function of this protective shield 26 is to protect the front end of the mount 10 and the drill drive against the molten metal streaming out the drilled tap-hole, when the tap-hole drill breaks through into the molten metal. As indicated in FIG. 1 by a broken line, the protective shield 26 has a through hole 32 for the tap-hole drill 14. Since this through hole 32 for the tap-hole drill 14 constitutes a weak point in the protective shield 26, its diameter should be only a few millimeters larger than the diameter of the drill rod 16.

Directly behind the protective shield 26 is located a metallic housing or cassette 34 containing the guiding means. A driving means 36 for the guiding means is partially arranged above the cassette 34. On the blast-furnace side, this driving means 36 is protected against splashes of molten metal by a removable sheet-metal housing 38.

Figure 2:
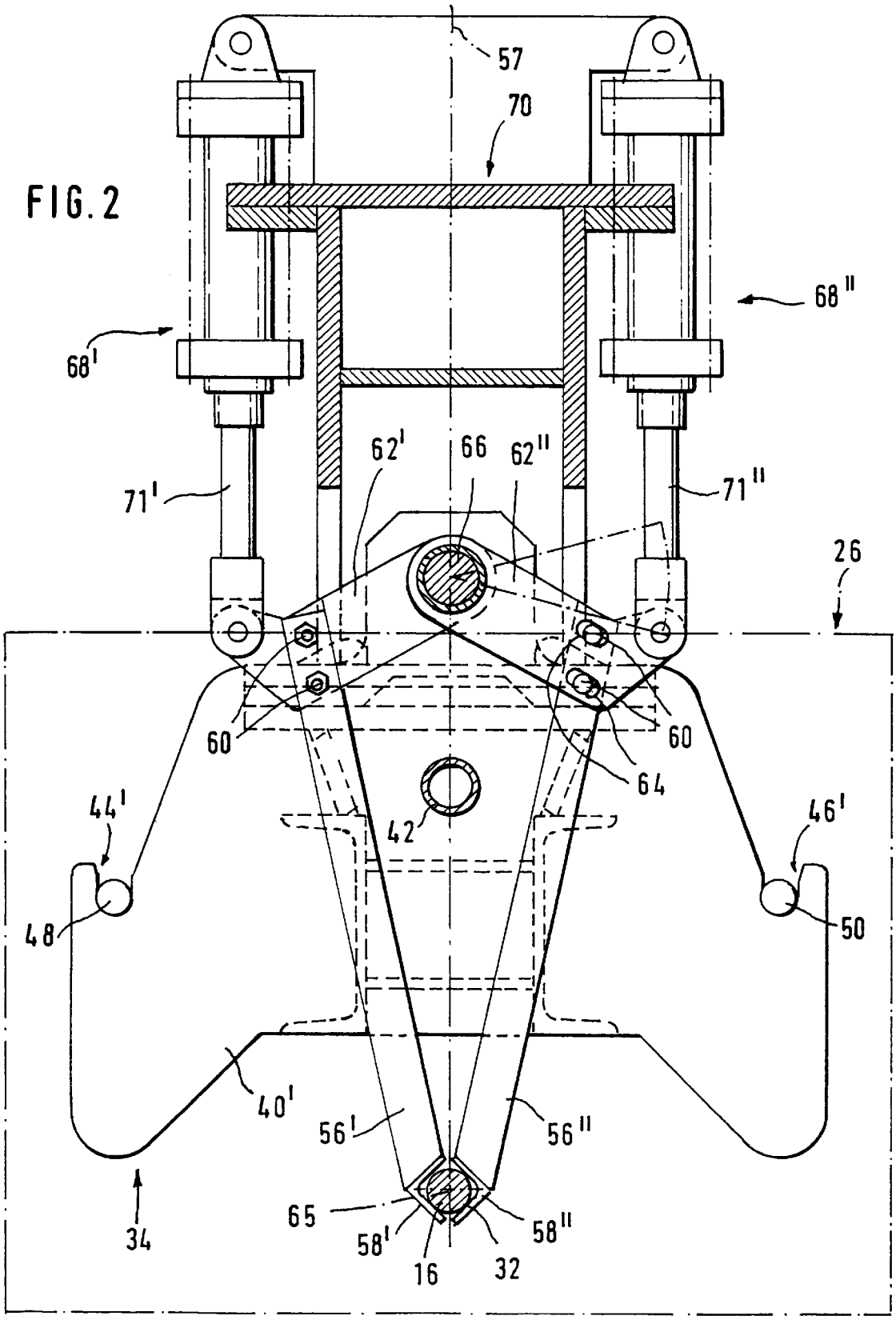
FIG. 2 a longitudinal section, corresponding to section line A—A in FIG. 1, wherein the guiding device is shown in a working position.

In FIG. 2, the outline of the protective shield 26 is indicated by interrupted lines. It will be observed that the protective shield 26 is slightly larger than the cassette 34 containing the guiding means. This cassette 34 comprises two plates 40', 40", which are connected by means of spacers, such as tubular sockets 42, for example, in such a way that they form a cavity between them. Only the rear plate 40' is shown in FIG. 2.

Figure 3:
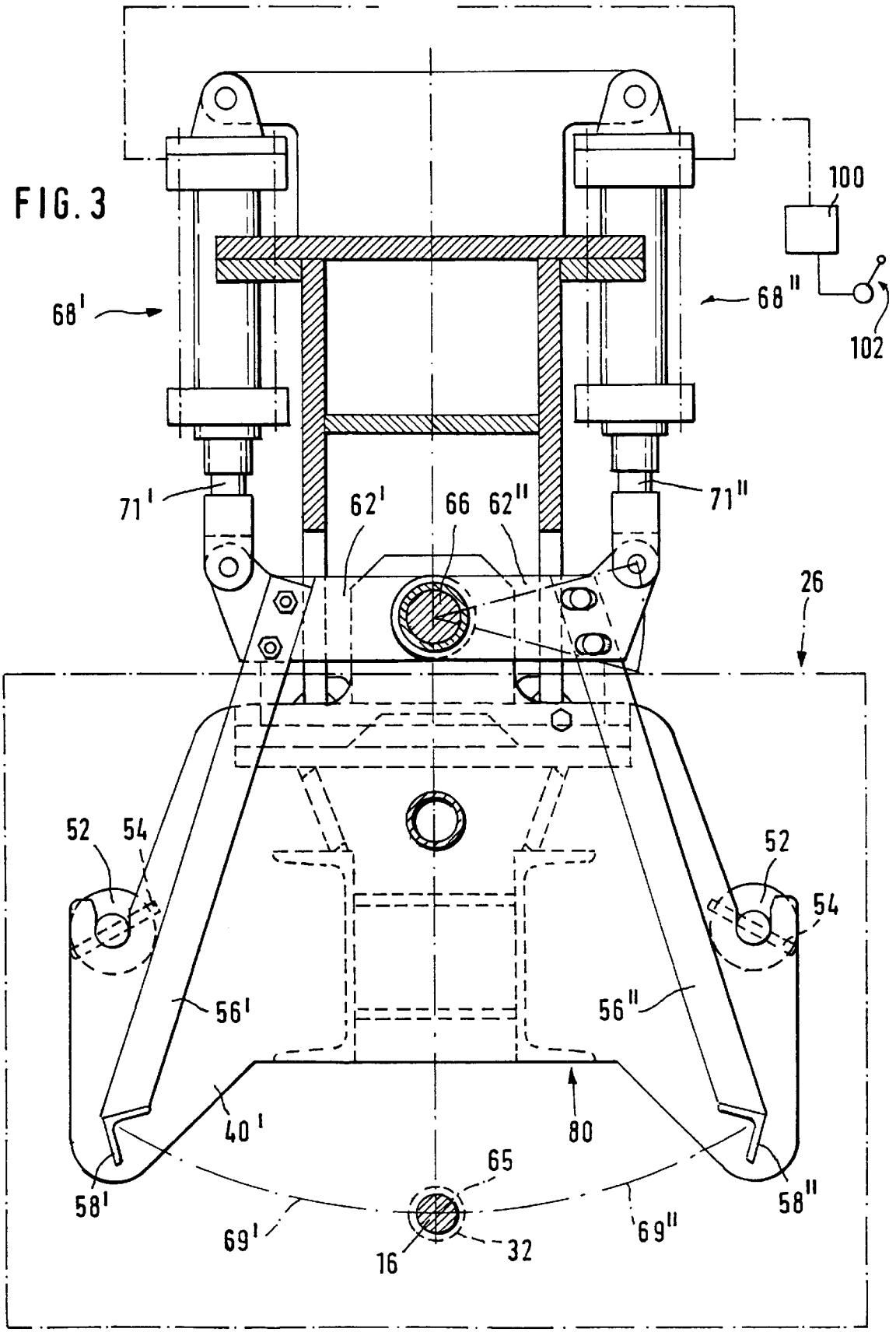
FIG. 3 a longitudinal section, corresponding to section line A—A in FIG. 1, wherein the guiding device is shown in a rest position.

The two plates 40', 40" have lateral upward-pointing hooks 44', 46' arranged axially one behind the other (the hooks in plate 40" are not shown in the Figures). Two hooks arranged axially one behind the other form a bearing for supporting pins 48, 50 of the protective screen 26. These supporting pins 48, 50 are at right angles to the protective screen 26 and are secured against axial displacement behind the plate 40'. In FIG. 3, for example, shims and locking pins are indicated as a securing means.

Between the plates 40', 40", two arms 56', 56" are arranged symmetrically in relation to a center line 57. At their bottom ends, projecting from the cassette 34, these arms 56', 56" each carry a guide section 58', 58". In the position shown in FIG. 2, two opposed angle-sections 58', 58" define a guide channel with a square cross-section for the drill rod 16, in an axial extension of the through hole 32 in the protective shield 26. Each of the two arms 56', 56" is firmly secured to a lever 62', 62" by means of screws 60. Elongated holes 64 enable the guide sections 58', 58" to be centered relative to the drilling axis 65. The two levers 62' and 62" are rotatably mounted on a common fulcrum 66. The central axis of this fulcrum 66 is parallel to the drilling axis 65. The above-mentioned central axis 57 intersects the central axis of the fulcrum 66 and the drilling axis 65.

The two levers 62' and 62" are connected to operating cylinders 68' and 68", respectively. These are preferably pneumatic cylinders. They are attached to a supporting frame 70, to which the cassette 34 holding the guiding means is also attached. As indicated earlier, the supporting frame 70 is suspended from the front end of the drill mount 10 by means of pins 24.

In FIG. 2, the pistons 71', 71" of the operating cylinders 68', 68" are in the extended position. In FIG. 3, the same pistons 71', 71" are retracted. When the pistons 71', 71" are retracted, the levers 62', 62" are pivoted upwards. The guide sections 58', 58" and the arms 56', 56" are then in a protected position at a relatively great distance from the through hole 32 in the protective shield 26, so that they can no longer be reached by jets and splashes of molten metal.

For mounting the tap-hole drill 16, the mount 10 has to be in a "parked" position beside the tap-hole 12, and the arms 56', 56" preferably assume the position shown in FIG. 3. The drilling rod 16 is inserted from the front into the through hole 32 in the protective shield 26 and is clamped in the chuck of the drill drive. Alternatively, the through hole 32 can be in the form of a slot, so that the full length of the drill rod 16 does not have to be inserted through the through hole 32 (see FIGS. 4 and 5). Then, by operating the operating cylinders 68', 68", the arms 56', 56" are pivoted into the position in FIG. 2, in which the drill rod 16 is perfectly guided between the two guide sections 58', 58". The mount 10 is moved to the drilling position, and the drill drive comes into operation. The drill rod 16 rotates between the two guide sections 58', 58", whereby the latter, together with the chuck at the rear end of the drill rod 16, perfectly define the drilling axis and prevent lateral deviation of the drilling head 18. The drilling head 18 penetrates into the hardened plug material. After roughly half of the tap-hole channel has been drilled, the danger of the tap-hole drill 14 deviating laterally is extremely small, so that the front guiding device is not longer needed. A control device, indicated diagrammatically in FIG. 3 by block 100, controls the operating cylinders 68', 68" in such a way that the arms 56', 56" and the guide sections 58', 58" are pivoted to the protected position, as shown in FIG. 3. For this purpose, the control device can, for example, have a switching element 102 which is arranged along the mount 10 and is operated by the drill drive, as soon as the latter passes a specified point on the mount in the tap-hole direction. It should be noted that, when the drill drive travels back, the arms 56', 56" with the guide sections 58', 58" remain in their protected position.

Since the pivoting arms 56', 56" with the guide sections 58', 58" swing back to the protected position, before the tap-hole is fully drilled, the risk of the guiding means coming into contact with the molten metal is greatly reduced. Since the through hole 32 in the protection shield 26 no longer has to perform a guiding function, light to average wear of the protective shield 26 in the region of the through hole 32 hardly impairs the function of the protective shield 26. In consequence, the protective shield 26 has to be changed less frequently.

It is also apparent from FIG. 3 that, after the protective shield 26 has been dismantled, the guiding device 22 is by no means a nuisance. If the tap-hole drilling machine is from time to time used to insert a tapping rod in the not-yet-hardened plug material, or to withdraw such a tapping rod from the hardened plug material. The large recess 80 in the lower part of plates 40' and 40" permits a relatively gentle and clearly-visible approach of the mount end of the free end of the tapping rod inserted in the hardened plug material. The guiding means 56', 58', 56", 58" are nevertheless in the protected position behind the plate 40".

Figure 4:
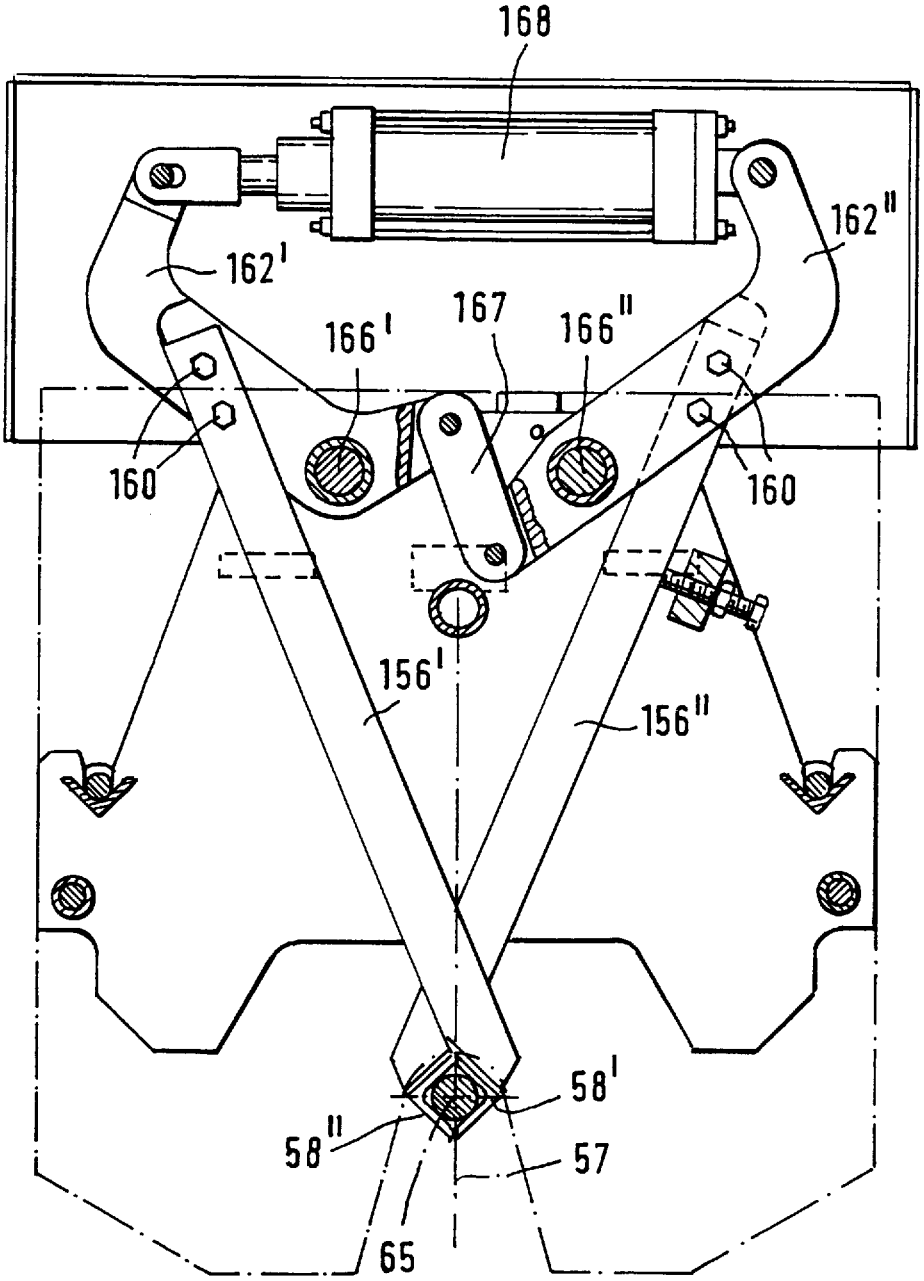
FIG. 4 a longitudinal section as in FIG. 2, showing an alternative embodiment of the guiding device in a working position.
Figure 5:
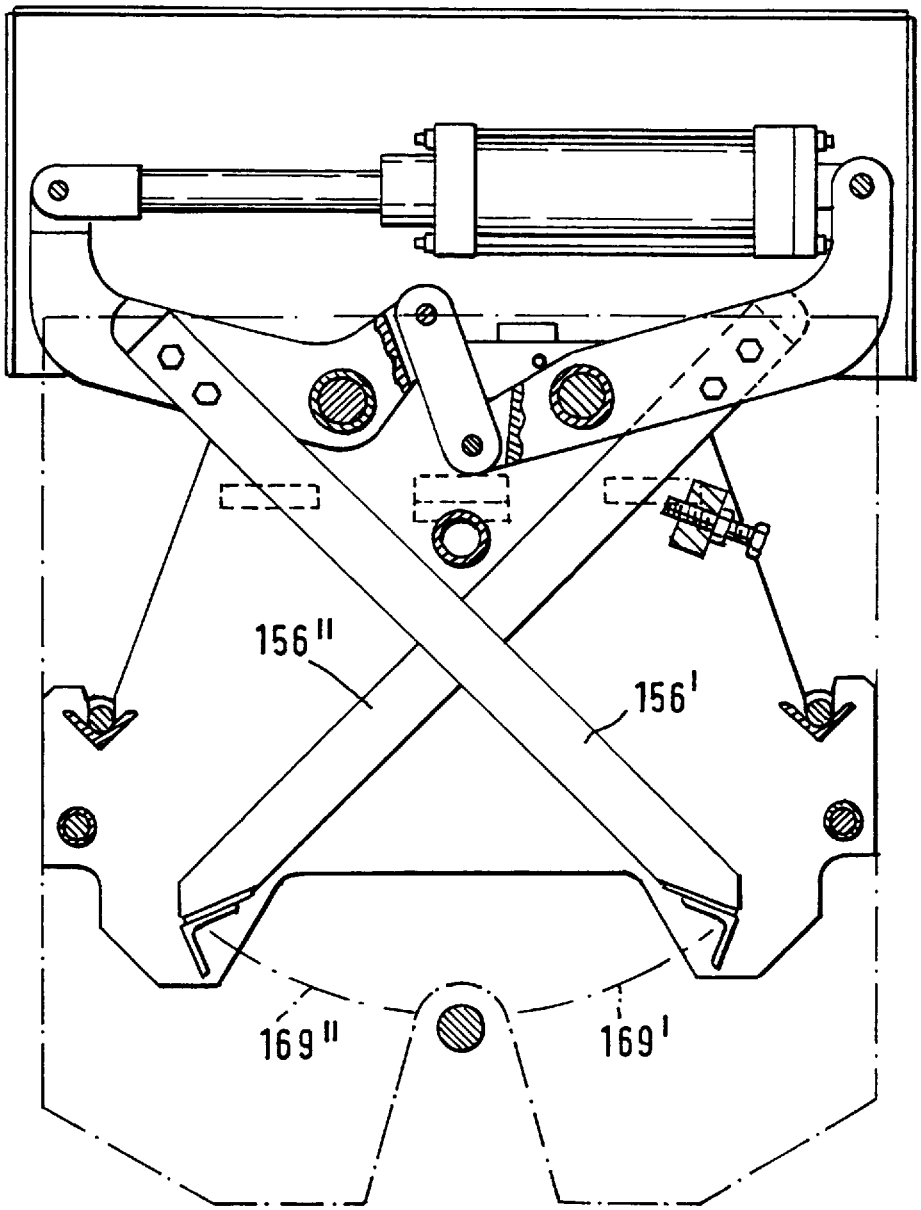
FIG. 5 a longitudinal section as in FIG. 3, showing the alternative embodiment of the guiding device in a rest position.

An alternative embodiment of the driving means is shown in FIGS. 4 and 5. It will be observed that the two arms 156', 156" are arranged crosswise symmetrically in relation to a center line 57. At their bottom ends, which in FIG. 4 are projecting from the cassette 34, these crossed arms 156', 156" each carry a guide section 58', 58", described above. Each of the two arms 156', 156" is firmly screwed to a lever 162' or 162" by means of screws 160. The two levers 162' and 162" are rotatably mounted on their own fulcrums 166', 166", in such a way that each lever 162', 162" forms a double-arm lever. A connecting member 167 and an operating cylinder 168 connect the lever arms of the levers 162' and 162" to form a closed mechanism. In FIG. 4, the piston of the operating cylinder 168 is retracted. The guiding means is in its working position. As the piston of the single operating cylinder 168 is extended, the arms 156', 156" are pivoted upwards crosswise, as can be seen in FIG. 5.

Comparison of FIG. 5 and FIG. 3 shows that, in the embodiment according to FIG. 5, when the lengths of arms 156', 156" and of arms 56', 56" are roughly equal, the pivoting paths 169', 169" of the guide sections 58', 58" exhibit an appreciably smaller diameter that the pivoting paths 69', 69" of guide sections 58', 58" in the embodiment according to FIG. 3. In other words, in the embodiment according to FIG. 3, the guide sections 58', 58" must be pivoted considerably further outwards in order to be raised to the same height relative to the mount as in the embodiment according to FIG. 3. By virtue of the crossed arms 156', 156", the guiding device of FIG. 5 is thus more compact in its rest position, which has a favorable effect on the flexibility of use of the tap-hole drilling machine.

What is claimed is:

1. A tap-hole drilling machine comprising:

an elongated mount for mounting thereon a tap-hole drill and supporting the tap-hole drill in a drilling position in front of a tap-hole of a shaft furnace, said mount having a front end to be arranged in front of and facing the tap-hole;

a compact cassette-form guiding and protection unit which is removably suspended on said front end of said mount, said unit including:

a supporting structure;

means for removably suspending said supporting structure on said front end of said mount;

a protective shield removably suspended on said supporting structure, said protective shield having a through hole for a tap-hole drill to be mounted on said mount;

a guiding means for a tap-hole drill, arranged on said supporting structure behind said protective shield, and a driving means arranged on said supporting structure to move said guiding means between a working position and a rest position, wherein, in said working position, said guiding means forms a drilling guide for a tap-hole drill, and wherein, in said rest position, said guiding means is located in a protected position behind said protective shield.

2. The tap-hole drilling machine of claim 1, wherein said supporting structure has a front plate facing said tap-hole when said mount is arranged in front of said tap-hole, said protective shield being suspended in front of said front plate.

3. The tap-hole drilling machine of claim 2, wherein, in said rest position, said guiding means is in a protected position behind said front plate, when said protective shield is removed, said front plate being smaller than said protective shield.

4. The tape hole drilling machine of claim 1, wherein said guiding means includes two pivotable arms, each having a guide section at its won free end, wherein, in said working position of said guiding means, said two guide sections co-operate with each other in such a way that they form a guide channel for a tap-hole drill.

5. The tap-hole drilling machine of claim 4, wherein said guide sections are angle sections.

6. The tap-hole drilling machine of claim 1, wherein said driving means has two levers, to which arms of said guiding means are firmly screwed.

7. The tap-hole drilling machine of claim 4, wherein said two pivotable arms are arranged crosswise.

8. The tap-hole drilling machine of claim 1, further comprising:

a drill drive which is displaceable along said mount and a control means which operates said driving means as a function of the position of said drill drive along said mount.

9. The tap-hole drilling machine of claim 1, wherein said through hole in said protective shield has the form of a slot.

10. The tap-hole drilling machine of claim 1, wherein said protective shield comprises a metal supporting plate with a coating or lining of a refractory material and two support-pins.

11. A tap-hole drilling machine, comprising:

a drill mount to be arranged in a drilling position front of a tap-hole of a furnace;

a cassette form guidance device which is removably supported by said mount and which includes a supporting structure and a tap-hole drill guidance mechanism supported by said supporting structure, said tap-hole drill guidance mechanism including a tap-hole drill guidance assembly and a drive unit in driving connection with said tap-hole drill guidance assembly, said drive unit having a first position which places said tap-hole drill guidance assembly in guidance contact with the tap-hole drill and a second position wherein said tap-hole drill guidance assembly is removed from guidance contact with the tap-hole drill;

said supporting structure and tap-hole drill guidance mechanism being combined as a compact cassette form unit such that said cassette form guidance device can be removed from the mount as a unit; and a protective shield supported by said support structure so as to be between the tap-hole of the furnace and said tap-hole drill guidance assembly.

12. A tap-hole drilling machine as recited in claim 11, further comprising a removable attachment member received by said supporting structure and said mount so as to preclude inadvertent detachment of said cassette form guidance device from said mount.

13. A tap-hole drilling machine as recited in claim 12, wherein said removable attachment member is a pin which is received by said supporting structure and said mount.

14. A tap-hole drilling machine as recited in claim 11, wherein said protective shield includes a through passageway for passing therethrough a tap-hole drill and is removably suspended on said supporting structure.

15. A tap-hole drilling machine as recited in claim 14, wherein said protective shield and supporting structure share a removable hook and pin attachment arrangement.

16. A tap-hole drilling machine as recited in claim 15, wherein said supporting structure includes a front plate having a pair of upward hook sections and said protective shield has a pair of bearing pins which are slideably received and retained by said upward hook sections.

17. A tap-hole drilling machine as recited in claim 11, wherein said supporting structure includes a front plate and a back plate spaced apart from each other, and said tap-hole drill guidance assembly being rotatably supported by said supporting structure between said front and back plates.

18. A tap-hole drilling machine as recited in claim 17, wherein said protective shield is removably suspended by said support structure in front of said front plate, and said drive unit being fixed in position by said supporting structure so as to be located above said front and back plates.

19. A tap-hole drilling machine as recited in claim 11, wherein said supporting structure includes a section which extends over and into contact with an upper surface of said mount and is held in position by detachable pin member which releasably locks said supporting structure to said mount.

20. A tap-hole drilling machine as recited in claim 11, wherein said supporting structure includes a front plate and said tap-hole drill guidance assembly includes a pair of arms each having a guide section at one end, and said guide sections being positioned behind said front plate so as to be protected by said front plate when said drive unit places said tap-hole drill guidance assembly in said second position.

* * * * *